United States Patent [19]

Taub

[11] Patent Number: 4,520,978

[45] Date of Patent: Jun. 4, 1985

[54] DISPLAY HANGER

[76] Inventor: Ronald H. Taub, 230 E. Ohio St., Chicago, Ill. 60611

[21] Appl. No.: 390,384

[22] Filed: Jun. 21, 1982

[51] Int. Cl.[3] ..... A47F 5/00

[52] U.S. Cl. ..... 248/220.4; 211/57.1; 211/59.1; 248/222.2; 248/309.2; D8/373

[58] Field of Search ..... 248/309 A, 220.3, 220.4, 248/222.2, 221.1, 221.2, 221.3, 309.2; 211/54.1, 57.1, 59.1; 40/19.5; D8/373, 363

[56] References Cited

U.S. PATENT DOCUMENTS

| | | | |
|---|---|---|---|
| 3,245,547 | 6/1954 | Felkay | 248/220.3 |
| 3,275,272 | 9/1966 | Kirk | 248/220.4 |
| 3,289,993 | 12/1966 | Thalenfeld | 248/220.4 |
| 3,374,898 | 3/1968 | Karmin | 248/221.1 |
| 3,645,485 | 2/1972 | Gold | 248/221.1 |
| 3,976,201 | 8/1976 | Hodgson et al. | 248/220.4 |
| 4,246,710 | 1/1981 | Mixer | 211/57.1 X |
| 4,258,892 | 3/1981 | Craine | 248/220.4 |
| 4,286,764 | 9/1981 | Pfeifer | 248/220.3 |
| 4,351,440 | 9/1982 | Thalenfeld | 248/220.4 |
| 4,394,909 | 7/1983 | Valiulis et al. | 248/220.3 |
| 4,405,051 | 9/1983 | Thalenfeld | 248/220.4 |

*Primary Examiner*—J. Franklin Foss
*Assistant Examiner*—David L. Talbott
*Attorney, Agent, or Firm*—Esther O. Kegan

[57] ABSTRACT

An improved display hanger increases the capacity of a merchandise display panel by utilizing a vertical extension between a product retaining arm or rod, and a hanger mounting connector. A plurality of the improved hangers mounted at the top of a display panel adds an additional row of merchandise carrying capacity to the panel, thus increasing the amount of merchandise available for consumer purchase.

1 Claim, 5 Drawing Figures

DISPLAY HANGER

BACKGROUND OF THE INVENTION

The present invention relates generally to improvements in display hangers used in retail and grocery stores to exhibit merchandise offered for sale, and, more particularly, to a display hanger which is vertically offset for adding an additional row of merchandise extending above the top of a display panel.

Heretofore, product display hangers have been used in conjunction with vertical display panels, such as a pegboard-type panel. Known display hangers have utilized a base including one or more hook-like locking lugs for selectably engaging the perforations in a pegboard-type display panel in order to mount the hanger into place thereon.

U.S. Pat. Nos. 3,275,272 and 3,289,993 disclose display hangers which utilize pivotal mounting members providing for inserting the hook-type retainer without arcuately moving the support arms.

U.S. Pat. Nos. 3,245,547, 3,374,898, 3,645,485, 3,976,201, 4,246,710 and 4,286,764 disclose a display hanger, but with an additional price rail or customer protective rod which extends above or to the front of the merchandise support arm therefore. None of these devices disclose a price rail capable of increasing the known capacity of a display panel.

A need has arisen for a display hanger capable of adding to the present or known product carrying capabilities of merchandise display panels for commercial use in retail stores and the like.

SUMMARY OF THE INVENTION

The invention is directed to a hanger adapted for increasing the merchandise carrying capacity of a product display panel. The hanger includes a connector adjacent the bottom thereof, a vertical extension portion rising from the connector, and a product supporting arm extending laterally outwardly adjacent the top of the extension.

The connector is selectably engagable with a display panel to maintain the hanger in mounted position thereon. The extension portion is a height greater than the height of the largest desired package to be positioned on the support arm, and the support arm has length sufficient for mounting a desired number of packages in dependent fashion therefrom.

It is a principal object of the invention to provide a display hanger which increases the capacity of a display panel by providing an extra row of hangers usable in the display of merchandise.

Another object of the invention is the provision of a vertical extension between a product support arm and a panel mounting member in a product display hanger which, when mounted adjacent the top of a display panel, expands the product carrying capacity of the panel.

BRIEF DESCRIPTION OF THE DRAWINGS

The features of the present invention, which are believed to be novel, are set forth with particularity in the appended claims. The invention may best be understood from the following detailed description of a currently preferred embodiment thereof, taken in conjunction with the accompanying drawings, wherein:

DETAILED DESCRIPTION OF THE PREFERRED EMBODIMENT

Figure 1:
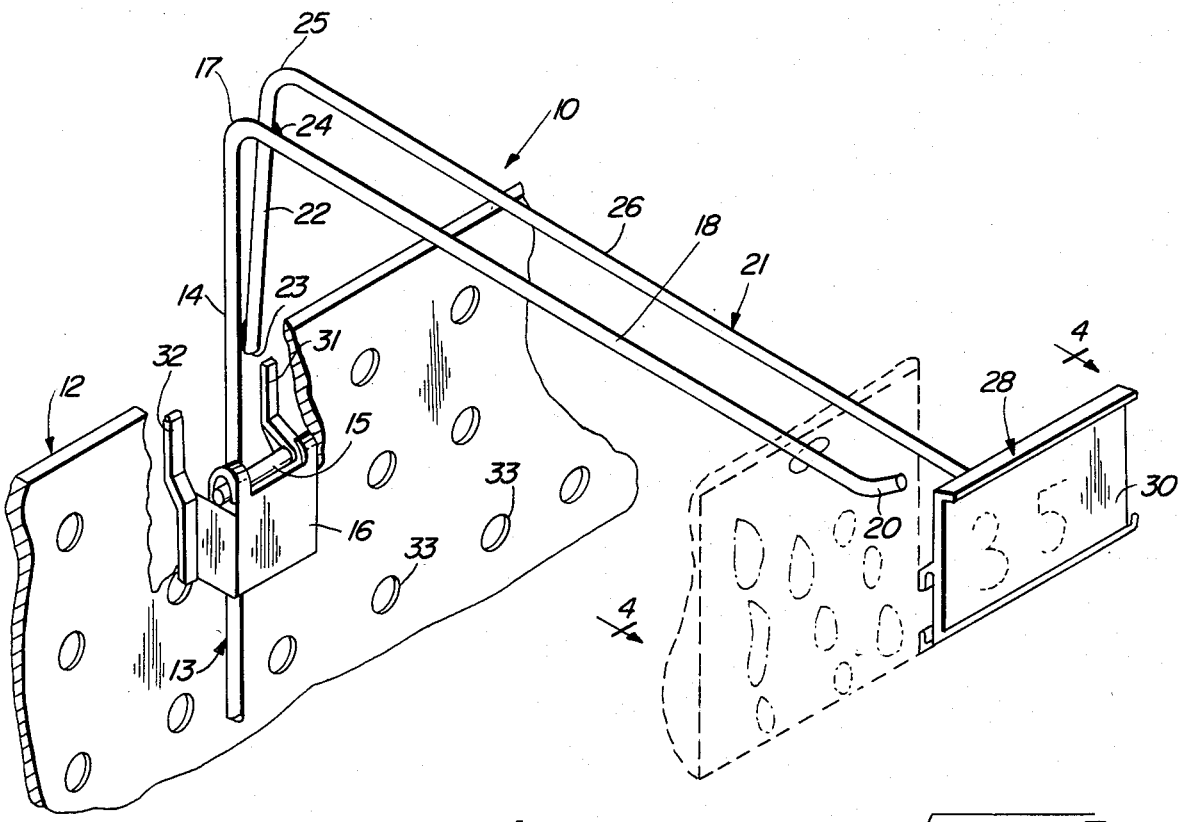
FIG. 1 is a fragmentary perspective view with part shown in a phantom, of a display hanger constructed in accordance with the invention mounted adjacent the top of a display panel with a package depending therefrom.
Figure 2:
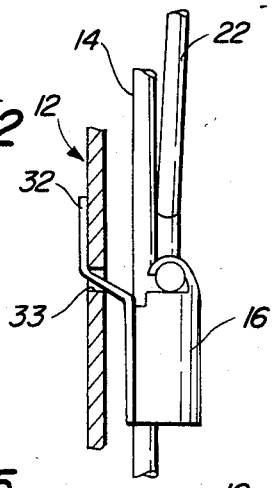
FIG. 2 is a fragmentary side elevational view of the hanger connector shown as mounted in a pegboard-type display panel.
Figure 3:
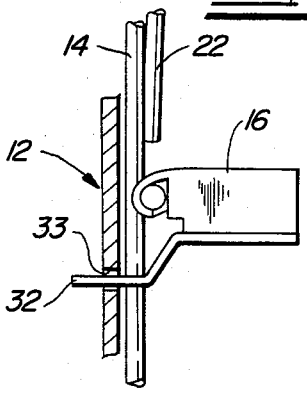
FIG. 3 is a fragmentary side elevational view similar to FIG. 2 showing the hanger connector as it appears when being mounted and removed from a display panel.

Referring to FIGS. 1–5, a preferred embodiment of the improved display hanger 10 constructed in accordance with the invention is shown connected on the top row of a perforated display panel 12. As seen in FIGS. 2–3, an independent connector element 20 much like those described in U.S. Pat. Nos. 3,275,272 and 3,289,993 is used for selectably engaging the hanger 10 to the panel 12 is attached to the hanger 10. In the embodiment shown, hanger 10, preferably made of steel, aluminum or the like, includes a main body or rod generally indicated at 13 which has a vertical arm portion 14, a cross brace rod 15 affixed thereto adjacent the bottom thereof to which a pegboard connector member 16 is pivotally retained. At the top of vertical arm portion 14 an elbow 17 is formed with a substantially horizontal package supporting arm 18 extending therefrom. The distal end of arm 18 is upwardly hooked or curled at 20 to retain packages, such as shown in phantom at 21, once they are positioned on arm 18 until they are removed therefrom by a consumer.

Figure 5:
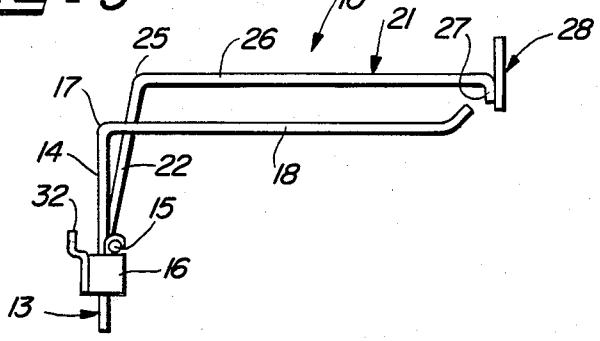
FIG. 5 is a side elevational view of the display hanger shown in FIG. 1.
Figure 4:
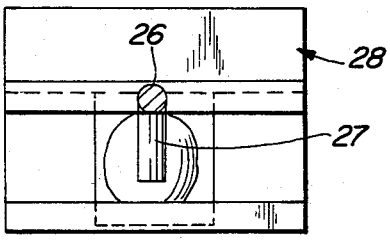
FIG. 4 is a cross sectional view taken along the lines 4—4 of FIG. 1.

As shown most clearly in FIGS. 1 and 5, the preferred embodiment also includes a price rail-protector bar, generally indicated at 21, having a vertical rise segment 22 beginning at a bottom end 23 and is attached to vertical arm 14 just above cross brace 15 and at 24, on arm 18 just laterally of elbow 17 preferably by spot welding, brazing, soldering, or the like. Rise segment 22 ends above package supporting arm 18 at a second elbow 25 from which a lateral arm 26 extends out past and spatially above the curled tip 20 of arm 18, where it bends downwardly at 27 (FIG. 4 and 5) for mounting a price rail 28 on the end thereof. Price rail 28 includes an information mounting front face 30 which is rectangular in shape for retaining pricing on other information thereon, and is large enough to provide a protective barrier preventing a consumer or other individual from coming into contact with distal end 20 of arm 18.

As shown most clearly in FIGS. 1–3, pegboard connector 16 is pivotally mounted on brace 15 and includes right and left stepped or S-bent fingers 31–32, respectively, which are spaced similarly to the spacing of holes 33—33 in pegboard 12. By swinging connector 16 to the horizontal as shown in FIG. 3, the hanger 10 may be positioned on a pegboard, preferably at the top thereof, and when swung to the vertical as in FIG. 2, the hanger is locked into position.

When in use, if the top row of typical display hangers is already mounted at or adjacent the top of a display panel, the improved hanger of the invention 10 may be mounted in holes immediately to the right or left of the ordinary display hanger. Such a mounting substantially preserves an orderly row and column appearance to the display while adding an additional top row of hangers above the rest.

The height of vertical portion 14 may vary depending upon the size of packages to be positioned thereon. In one embodiment, the vertical portion is nine inches in height and the support arm 18 is 13½ inches in length. The spacing between fingers 31–32 approximates one inch, and the price rail has a vertical rise of 7 inches and a lateral extension of 14 inches. The position of the price rail lateral arm 26 varies from 1¼ to 1½ inches above the support arm 18, and it extends approximately ¾ inch beyond the curled tip 20. A preferred material for price rail 28 is plastic.

Thus, a new and improved merchandise display hanger has been shown and described which is capable of adding a row of product packages to a conventional pegboard or other display panel. While the connector 16 shown is adapted for pegboard use, it will be appreciated that other connectors may be utilized within the invention to mount the hanger to other walls, rails or the like. While one particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

The invention is claimed as follows:

1. A hanger adapted for increasing the merchandise carrying capacity of a product display comprising:

a body including connector means adjacent the bottom thereof, a vertical extension rod rising vertically upward from said connector means, and a product support rod extending laterally outward adjacent the top of said vertical extension rod;

said connector means being selectably engaged with a product display stand to maintain the hanger in mounted position thereon;

said vertical extension rod being a height greater than the height of the largest desired package to be positioned on said product support rod, said product support rod being a length sufficient for mounting a desired number of packages in dependent fashion thereon;

said vertical extension rod and said product support rod being made of one elongated rod having a first elbow intermediate opposing ends of said rods defining a boundary therebetween to define said vertical extension rod and said product support rod such that said first elbow connects said opposing ends thereof;

said connector means including a pair of spatially related, substantially parallel finger-like projections adapted for positioning in adjacent apertures in a pegboard-type panel, said finger-like projections each including a stepped portion thereon for retention of said finger-like projections on said panel once positioned partly through the apertures thereof;

a price rail for carrying selectable information thereon;

a price rail-holding rod including a lateral extension portion positioned spatially above said product support rod and extending laterally beyond a distal end of said product support rod, said price rail rod also having a vertical portion extending upwardly from a portion of said vertical extension rod, said vertical portion of said price rail-holding rod having a lower end fixedly secured to said portion of said vertical extension rod for firm and fixed connection therewith;

said vertical portion of said price rail-holding rod extending upwardly from said portion of said vertical extension rod in an imaginary plane forming an acute angle with an imaginary plane in which said vertical extension rod extends, so that said lateral extension portion of said price rail-holding rod is spaced laterally from said product support rod and substantially parallel thereto along at least most of the length of said lateral extension portion of said price rail-holding rod;

said vertical portion being tilted forward with respect to said vertical extension rod such that an upper portion of said vertical portion projects above a portion of said product support rod, which portion of said product support rod is spaced from said first elbow defining the boundary between said product support rod and said vertical extension rod in a direction away from said connecting means; said vertical portion also being fixedly connected to said portion of said product support rod at a laterally adjacent section of said vertical portion, whereby said vertical portion is permanently affixed to said elongate rod at two spaced portions thereof on each side of said first elbow.

* * * * *